US011124980B1

(12) United States Patent
Magda

(10) Patent No.: US 11,124,980 B1
(45) Date of Patent: Sep. 21, 2021

(54) POOL DIVIDER ASSEMBLY

(71) Applicant: Eugene Magda, Kitchener (CA)

(72) Inventor: Eugene Magda, Kitchener (CA)

( * ) Notice: Subject to any disclaimer, the term of this patent is extended or adjusted under 35 U.S.C. 154(b) by 0 days.

(21) Appl. No.: 16/849,032

(22) Filed: Apr. 15, 2020

(51) Int. Cl.
*E04H 4/14* (2006.01)

(52) U.S. Cl.
CPC ..... *E04H 4/145* (2013.01)

(58) Field of Classification Search
CPC ..... E04H 4/145
USPC ..... 4/505, 486, 496; 482/55
See application file for complete search history.

(56) References Cited

U.S. PATENT DOCUMENTS 1,707,869 A * 4/1929 Mitchell ..... A01D 46/087 383/119
3,460,166 A * 8/1969 Weber ..... E04H 4/129 4/493
3,582,999 A * 6/1971 Baker ..... E04H 4/145 4/505
3,621,496 A 11/1971 McWilliams
3,640,073 A * 2/1972 Samsel ..... E02B 15/0814 405/70
3,813,703 A * 6/1974 Beaudin, Jr. ..... E04H 4/065 4/487
3,842,484 A * 10/1974 Stark ..... E04H 4/145 29/469
4,065,923 A * 1/1978 Preus ..... E02B 15/06 405/70
4,166,295 A * 9/1979 Schiron ..... E04H 4/0075 4/505
4,206,521 A * 6/1980 Davidson ..... E04H 4/00 4/505
4,524,711 A * 6/1985 Ashrow ..... A63B 69/12 114/215
4,688,024 A * 8/1987 Gadde ..... F41H 11/05 256/1
4,707,869 A 11/1987 Ray
4,763,944 A * 8/1988 Fry ..... B60P 7/14 296/180.1
5,033,735 A * 7/1991 Erickson ..... A63B 1/00 482/39
5,054,960 A * 10/1991 Manzano ..... E02B 15/08 405/72
D325,016 S 3/1992 Moore
5,953,767 A * 9/1999 Cloffey ..... E04H 4/065 4/487
6,055,683 A * 5/2000 Komer ..... E04H 4/143 4/496
6,251,049 B1 * 6/2001 Milton ..... A63B 69/12 434/254
6,742,197 B2 * 6/2004 Colletto ..... E04H 4/145 4/505

(Continued)

*Primary Examiner* — Lori L Baker

(57) ABSTRACT

A pool divider assembly for restricting access to a deep portion of a swimming pool includes a pair of rods. Each of the rods is extendable downwardly into a swimming pool adjacent to opposite sides of the swimming pool with respect to each other. Each of the rods has an engagement thereon and the engagement on each of the rods engages a respective well in a deck of the swimming pool to inhibit the rods from moving. A barrier is coupled between each of the rods to inhibit a child or a non-swimming adult from passing beyond the barrier. The barrier is comprised of a fluid permeable material to facilitate pool water to pass therethrough.

6 Claims, 6 Drawing Sheets

(56) References Cited

U.S. PATENT DOCUMENTS

| | | | | |
|---|---|---|---|---|
| 6,749,241 | B1 * | 6/2004 | Erlandsson | B60R 7/005 296/24.4 |
| 6,817,644 | B2 * | 11/2004 | Moore | B60R 7/005 296/24.43 |
| 7,104,932 | B1 * | 9/2006 | Brentlinger | A63B 69/12 434/254 |
| 7,175,569 | B1 * | 2/2007 | Lan | A63B 69/12 434/254 |
| 7,451,499 | B1 * | 11/2008 | Trotter | E04H 4/065 4/487 |
| 7,870,621 | B2 * | 1/2011 | Zeng | E04H 4/129 4/505 |
| 10,648,189 | B2 * | 5/2020 | DeSantis | A63B 69/12 |
| 2007/0039092 | A1 * | 2/2007 | Murdock | E04H 4/144 4/496 |
| 2013/0000033 | A1 * | 1/2013 | Gilleran | A47K 3/001 4/559 |
| 2013/0221301 | A1 * | 8/2013 | Cowie | E04H 17/00 256/24 |
| 2015/0082533 | A1 * | 3/2015 | Corbett | E04H 4/145 4/505 |
| 2020/0323719 | A1 * | 10/2020 | Berg | A61G 7/1005 |

* cited by examiner

POOL DIVIDER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to divider devices and more particularly pertains to a new divider device for restricting access to a deep portion of a swimming pool.

(2) Description of Related Art Including Information Disclosed Under 37 CFR 1.97 and 1.98

The prior art relates to divider devices including a swimming pool that has temperature barriers therein for establishing a plurality of portions of a swimming pool of differing temperatures. The prior art discloses a mobile swimming pool barrier that is rollable on tracks that extend alongside a swimming pool. The prior art also discloses a removable thermal barrier for a swimming pool that includes water ports for passing water therethrough. The prior art discloses a division frame that is positionable at a transition between a deep portion of a swimming pool and a shallow portion of a swimming pool.

BRIEF SUMMARY OF THE INVENTION

An embodiment of the disclosure meets the needs presented above by generally comprising a pair of rods. Each of the rods is extendable downwardly into a swimming pool adjacent to opposite sides of the swimming pool with respect to each other. Each of the rods has an engagement thereon and the engagement on each of the rods engages a respective well in a deck of the swimming pool to inhibit the rods from moving. A barrier is coupled between each of the rods to inhibit a child or a non-swimming adult from passing beyond the barrier. The barrier is comprised of a fluid permeable material to facilitate pool water to pass therethrough.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
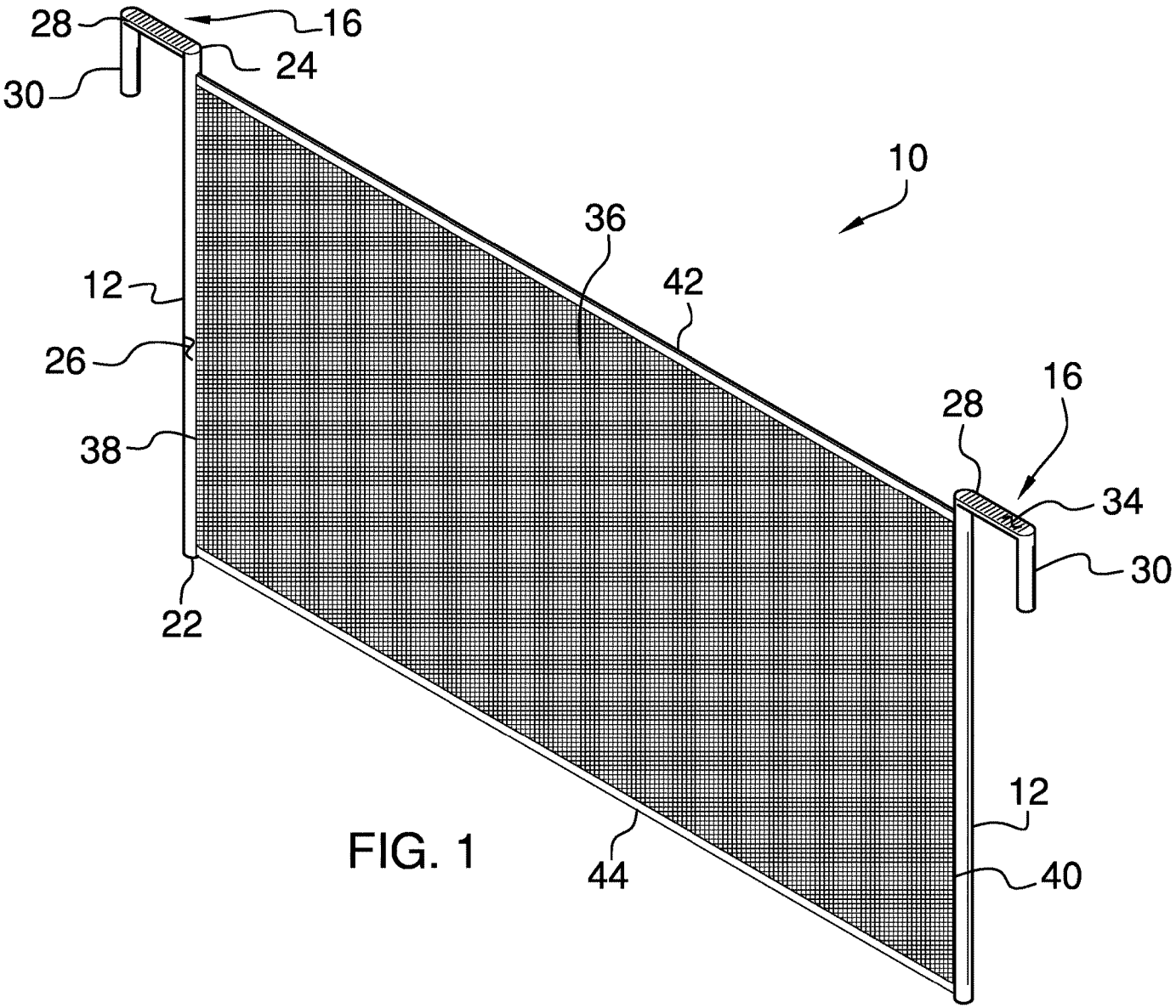
FIG. 1 is a front perspective view of a pool divider assembly according to an embodiment of the disclosure.
Figure 2:
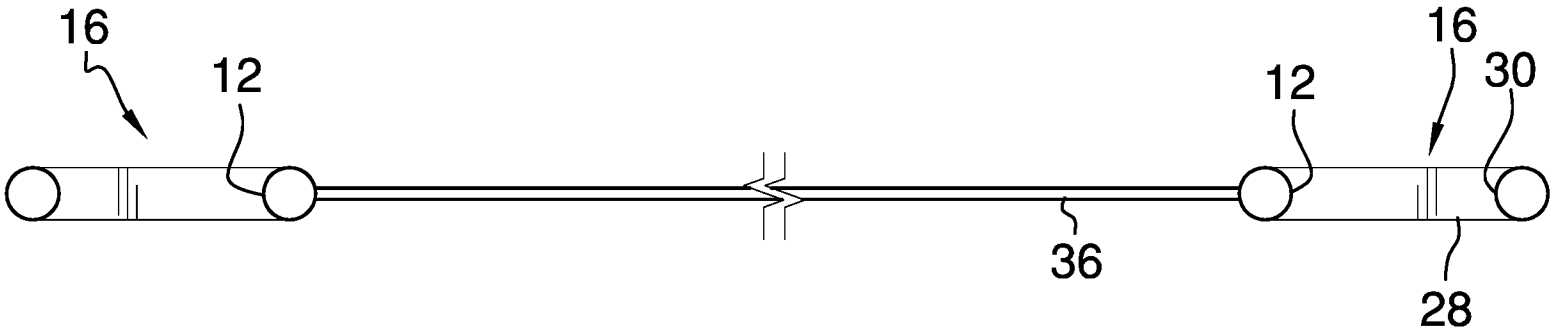
FIG. 2 is a bottom view of an embodiment of the disclosure.
Figure 3:
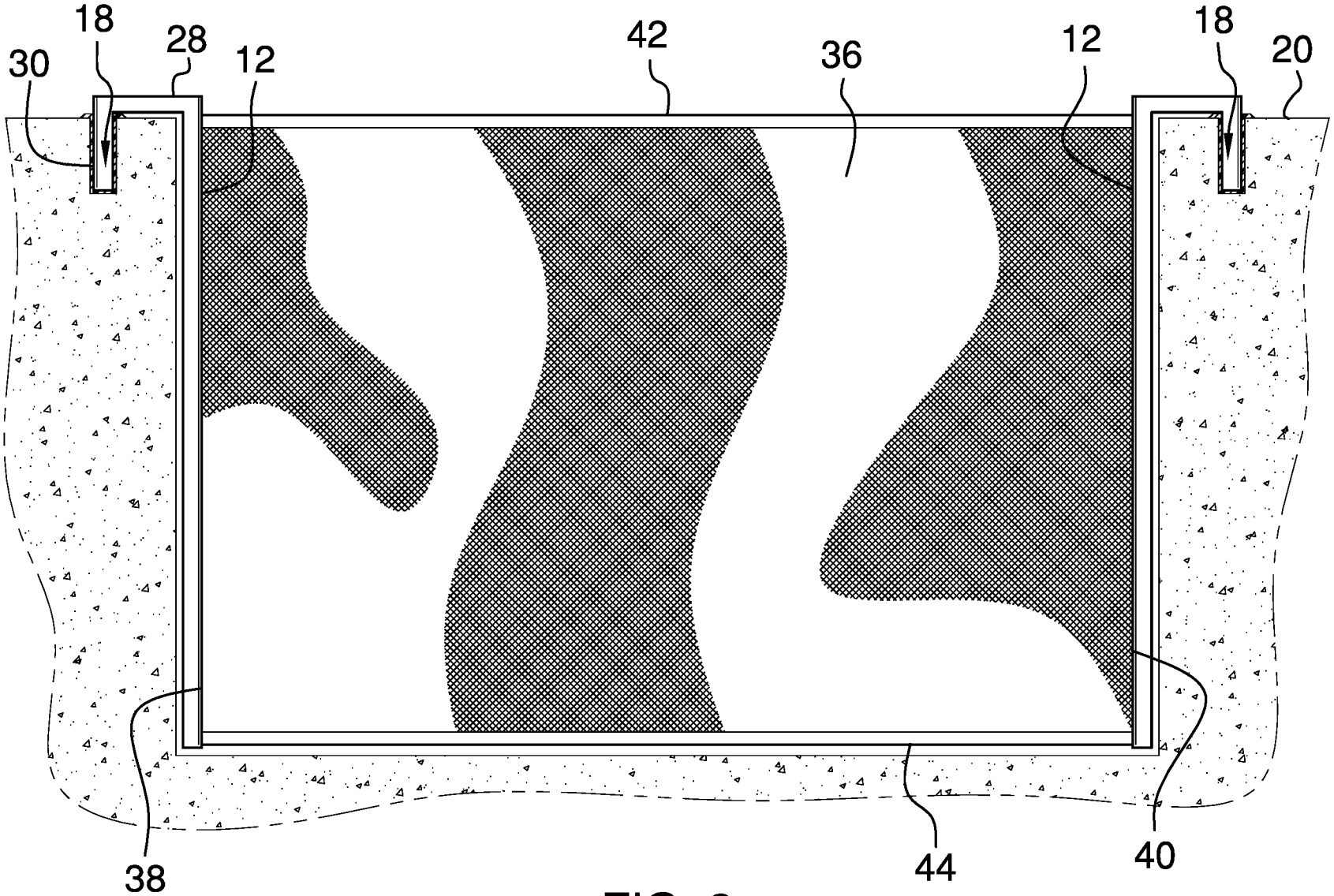
FIG. 3 is a front in-use view of an embodiment of the disclosure.
Figure 4:
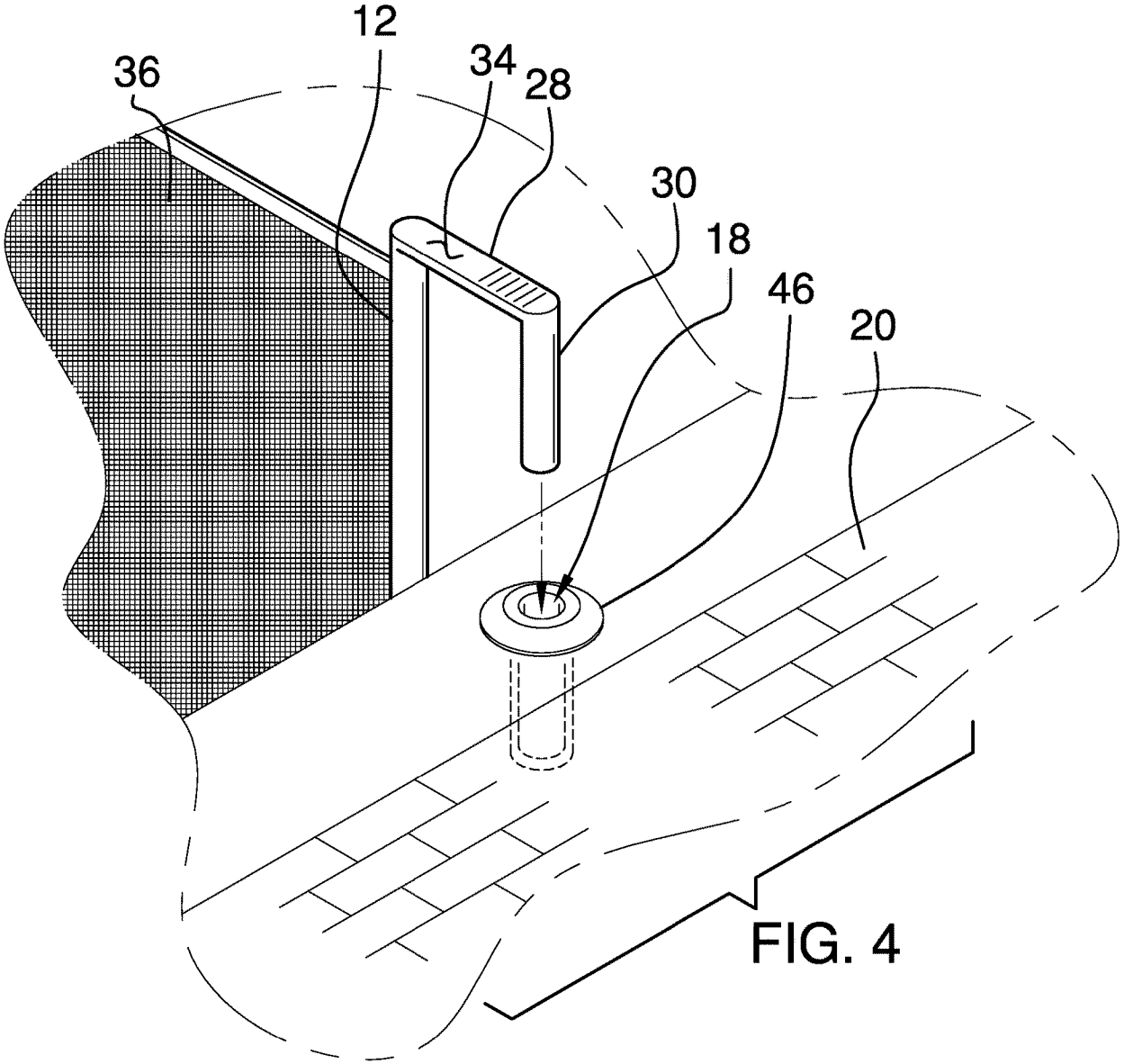
FIG. 4 is a perspective view of an embodiment of the disclosure showing an engagement being inserted into a well.
Figure 5:
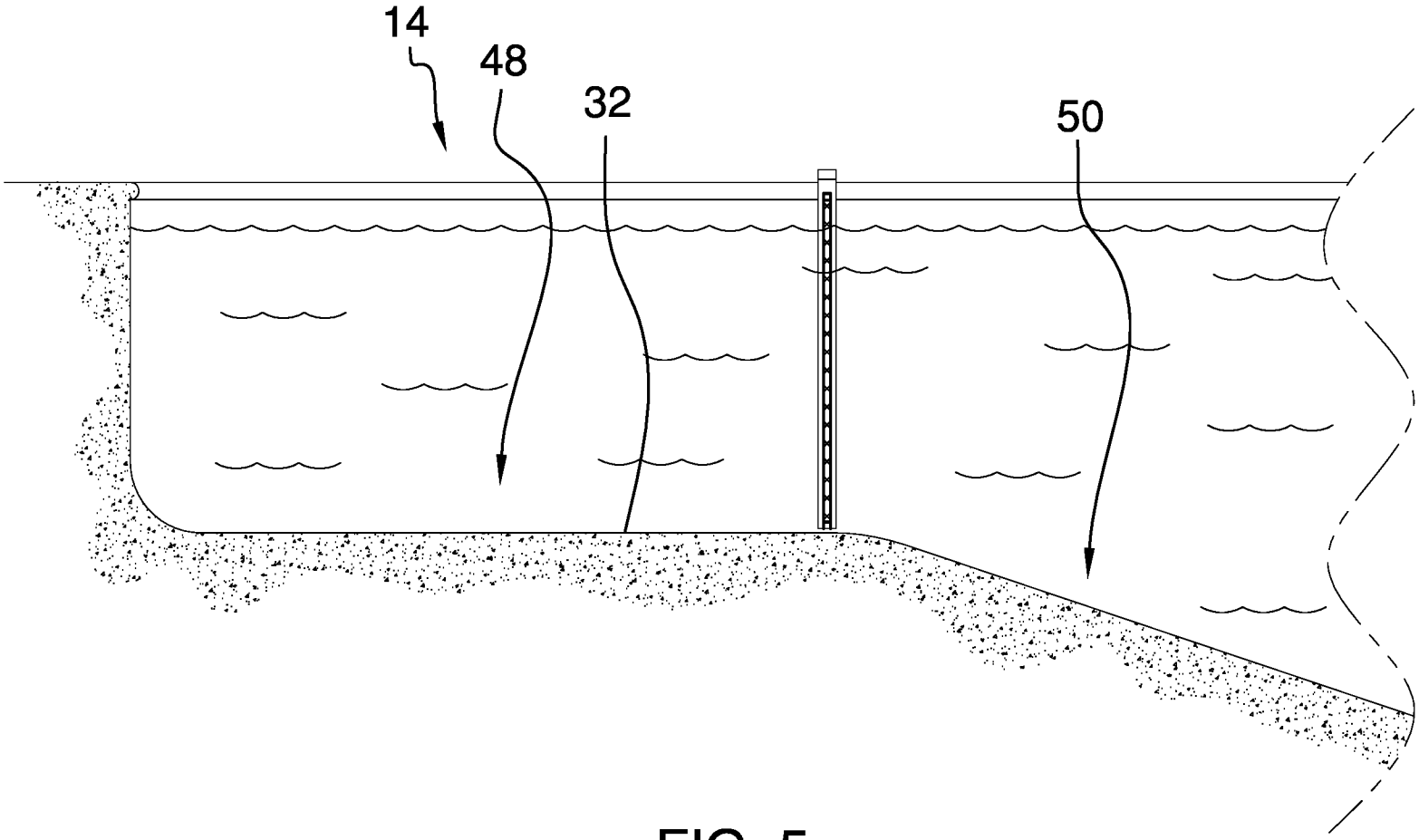
FIG. 5 is a side in-use view of an embodiment of the disclosure.

With reference now to the drawings, and in particular to FIGS. 1 through 6 thereof, a new divider device embodying the principles and concepts of an embodiment of the disclosure and generally designated by the reference numeral 10 will be described.

As best illustrated in FIGS. 1 through 6, the pool divider assembly 10 generally comprises a pair of rods 12 that are each extendable downwardly into a swimming pool 14 adjacent to opposite sides of the swimming pool 14 with respect to each other. Each of the rods 12 has an engagement 16 thereon and the engagement 16 on each of the rods 12 engages a respective well 18 in a deck 20 of the swimming pool 14 to inhibit the rods 12 from moving. The swimming pool 14 may be an above ground swimming pool of any conventional design or a below ground swimming pool of any conventional design.

Each of the rods 12 has a first end 22, a second end 24 and an outer surface 26 extending therebetween. The engagement 16 on each of the rods 12 comprises a leg 28 extending away from the second end 24 and a foot 30 extending downwardly from the leg 28. The foot 30 of each engagement 16 slides downwardly into the respective well 18 in the deck 20 of the swimming pool 14 having the second end 24 of the rods 12 being positioned adjacent to a bottom 32 of the swimming pool 14. The leg 28 of each engagement 16 has a top surface 34 and the top surface 34 of the leg 28 of the engagement 16 is textured. In this way the top surface 34 inhibits a person from slipping when the person steps on the top surface 34.

A barrier 36 is provided and the barrier 36 is coupled between each of the rods 12. In this way the barrier 36 can inhibit a child or a non-swimming adult from passing beyond the barrier 36. The barrier 36 is comprised of a fluid permeable material to facilitate pool 14 water to pass therethrough. The barrier 36 has a first lateral edge 38, a second lateral edge 40, a top edge 42 and a bottom edge 44, and each of the first lateral edge 38 and the second lateral edge 40 is coupled to the outer surface 26 of a respective one of the rods 12. Additionally, the barrier 36 extends substantially between the first end 22 and the second end 24 of the rods 12. As is most clearly shown in FIGS. 3 and 4, a sleeve 46 may be inserted into each of the wells 18 in the deck 20 of the swimming pool 14 for accommodating the foot 30 on each engagement 16. Moreover, each of the wells 18 may be aligned with a transition point between a shallow portion 48 of the swimming pool 14 and a deep portion 50 of the swimming pool 14.

Figure 6:
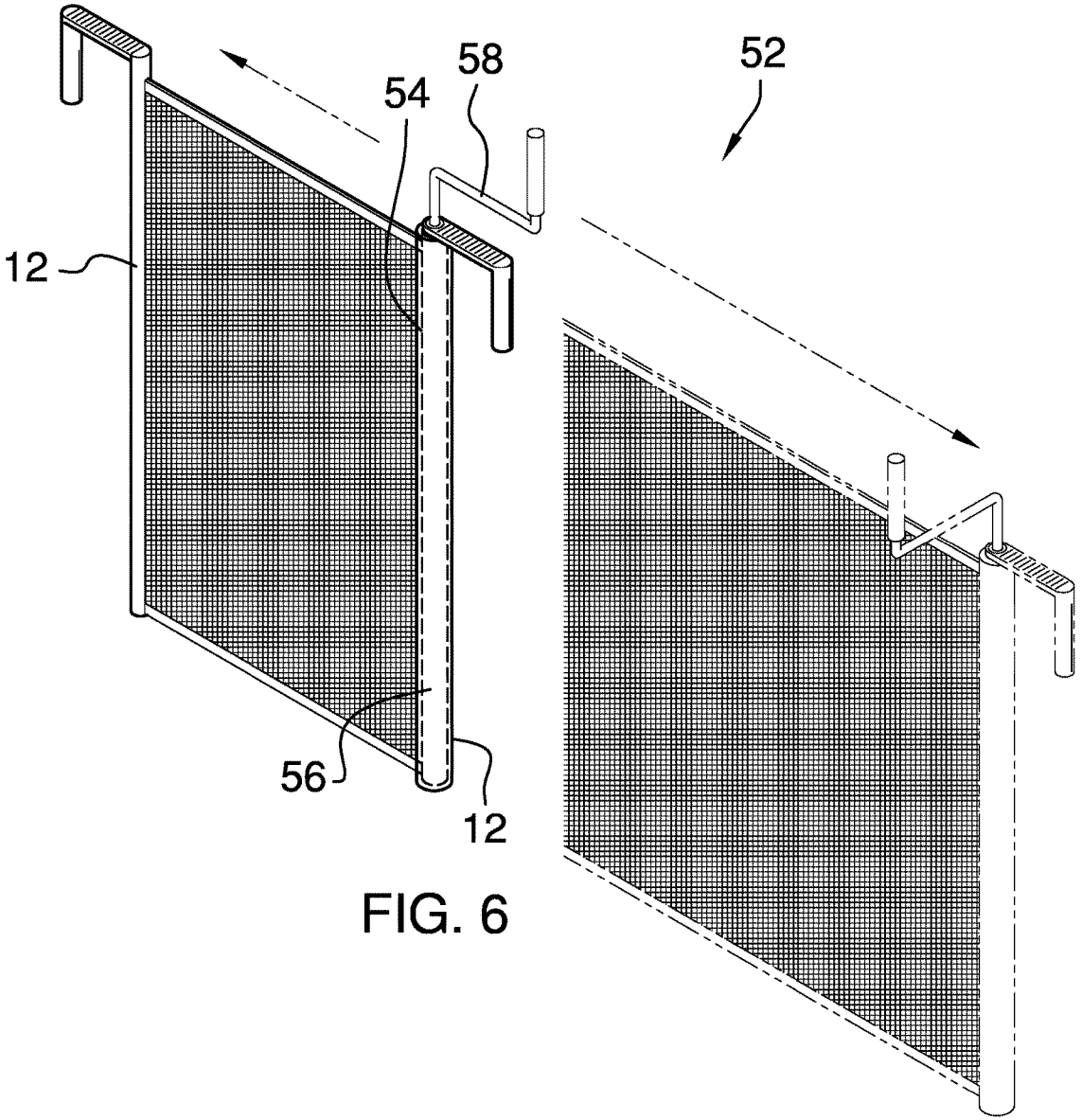
FIG. 6 is a perspective in-use view of an embodiment of the disclosure.

In an alternative embodiment 52 as is most clearly shown in FIG. 6, a respective one of the rods 12 is hollow. The outer surface 26 of the respective rod 12 has a slot 54 extending into an interior of the respective rod 12. Additionally, the slot 54 extends substantially between the first end 22 and the second end 24 of the respective rod 12. Continuing in the alternative embodiment 52, a crank 56 is provided that is rotatably positioned within the respective rod 12 that is hollow. The crank 56 has a handle 58 extending upwardly through the second end 24 of the respective rod 12 such that the handle 58 can be rotated by a user.

The barrier 36 extends through the slot 54 in the respective rod 12 that is hollow and the second lateral edge 40 of the barrier 36 is attached to the crank 56. The barrier 36 is wrapped around the crank 56 when the handle 58 is rotated in a first direction for shortening the barrier 36. The barrier 36 is drawn outwardly through the slot 54 when the handle 58 is rotated in a second direction for lengthening the barrier 36. In this way the barrier 36 can extend across swimming pools 14 of varying widths.

In use, the foot 30 on the engagement 16 on each of the rods 12 is lowered into the respective well 18 in the deck 20 of the swimming pool 14. In this way the barrier 36 extends across the swimming pool 14 to inhibit children or non-swimming adults from passing the barrier 36. Moreover, the barrier 36 may be aligned with a transition between the shallow portion 48 of the pool 14 and the deep portion 50 of the pool 14. In this way the barrier 36 enhances the safety of the children and non-swimming adults that are swimming in the swimming pool 14 that may inadvertently slip, swim or otherwise enter the deep portion of the swimming pool 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A pool divider assembly for presenting a barrier between a shallow end of a pool and a deep end of a pool for the protection of children and non-swimmers, said assembly comprising:

a pair of rods, each of said rods being extendable downwardly into a swimming pool adjacent to opposite sides of the swimming pool with respect to each other, each of said rods having an engagement thereon, said engagement on each of said rods engaging a respective well in a deck of the swimming pool to inhibit said rods from moving;

a barrier being coupled between each of said rods wherein said barrier is configured to inhibit a child or a non-swimming adult from passing beyond said barrier, said barrier being comprised of a fluid permeable material wherein said barrier is configured to facilitate pool water to pass therethrough; and wherein each of said rods has a first end, a second end and an outer surface extending therebetween, said engagement on each of said rods comprising a leg extending away from said second end and a foot extending downwardly from said leg, said foot of each of said engagements sliding downwardly into the respective well in the deck of the swimming pool having said second end of said rods being positioned adjacent to a bottom of the swimming pool.

2. The assembly according to claim 1, wherein said leg of each of said engagements has a top surface, said top surface of said leg of each of said engagements being textured wherein said top surface of configured to inhibit a person from slipping when the person steps on said top surface.

3. The assembly according to claim 1, wherein said barrier has a first lateral edge, a second lateral edge, a top edge and a bottom edge, each of said first lateral edge and said second lateral edge being coupled to said outer surface of a respective one of said rods, said barrier extending substantially between said first end and said second end of said rods.

4. A pool divider assembly for presenting a barrier between a shallow end of a pool and a deep end of a pool for the protection of children and non-swimmers, said assembly comprising:

a pair of rods, each of said rods being extendable downwardly into a swimming pool adjacent to opposite sides of the swimming pool with respect to each other, each of said rods having an engagement thereon, said engagement on each of said rods engaging a respective well in a deck of the swimming pool to inhibit said rods from moving, each of said rods having a first end, a second end and an outer surface extending therebetween, said engagement on each of said rods comprising a leg extending away from said second end and a foot extending downwardly from said leg, said foot of each of said engagements sliding downwardly into the respective well in the deck of the swimming pool having said second end of said rods being positioned adjacent to a bottom of the swimming pool, said leg of each of said engagements having a top surface, said top surface of said leg of each of said engagements being textured wherein said top surface of configured to inhibit a person from slipping when the person steps on said top surface; and a barrier being coupled between each of said rods wherein said barrier is configured to inhibit a child or a non-swimming adult from passing beyond said barrier, said barrier being comprised of a fluid permeable material wherein said barrier is configured to facilitate pool water to pass therethrough, said barrier having a first lateral edge, a second lateral edge, a top edge and a bottom edge, each of said first lateral edge and said second lateral edge being coupled to said outer surface of a respective one of said rods, said barrier extending substantially between said first end and said second end of said rods.

5. The assembly according to claim 4, wherein:

a respective one of said rods is hollow, said outer surface of said respective rod having a slot extending into an interior of said respective rod, said slot extending substantially between said first end and said second end of said respective rod; and said assembly includes a crank being rotatably positioned within said respective rod being hollow, said crank having a handle extending upwardly through said second end of said respective rod wherein said handle is configured to be rotated by a user.

6. The assembly according to claim 5, wherein said barrier extends through said slot in said respective rod being hollow, said second lateral edge of said barrier being attached to said crank, said barrier being wrapped around said crank when said handle is rotated in a first direction for shortening said barrier, said barrier being drawn outwardly through said slot when said handle is rotated in a second direction for lengthening said barrier.

* * * * *